US005939988A

United States Patent [19]

Neyhart

[11] Patent Number: 5,939,988

[45] Date of Patent: Aug. 17, 1999

[54] CHILD PROXIMITY MONITOR AND ALARM

[76] Inventor: Gene Michael Neyhart, 453 W. 700 North, Porter County, Valparaiso, Ind. 46383

[21] Appl. No.: 09/127,269

[22] Filed: Jul. 31, 1998

[51] Int. Cl.[6] ..... G08B 21/00

[52] U.S. Cl. ..... 340/573.4; 340/539

[58] Field of Search ..... 340/573.4, 539

[56] References Cited

U.S. PATENT DOCUMENTS

| | | | |
|---|---|---|---|
| 4,063,410 | 12/1977 | Welling | 368/10 |
| 4,675,656 | 6/1987 | Narcisse | 340/573.4 |
| 4,694,284 | 9/1987 | Leveille et al. | 340/574 |
| 4,736,196 | 4/1988 | McMahon et al. | 340/573.4 |
| 4,785,291 | 11/1988 | Hawthorne | 340/539 |
| 4,954,836 | 9/1990 | Sakuma | 342/450 |
| 5,067,441 | 11/1991 | Weinstein | 119/721 |
| 5,420,570 | 5/1995 | Leitten et al. | 340/574 |
| 5,438,315 | 8/1995 | Nix | 340/539 |
| 5,461,366 | 10/1995 | Figuereo et al. | 340/574 |
| 5,559,498 | 9/1996 | Westrick et al. | 340/573.3 |
| 5,565,850 | 10/1996 | Yarnall, Jr. et al. | 340/573.3 |
| 5,610,588 | 3/1997 | Yarnall, Jr. et al. | 340/573.3 |
| 5,617,074 | 4/1997 | White | 340/573.4 |
| 5,661,460 | 8/1997 | Sallen et al. | 340/539 |
| 5,689,240 | 11/1997 | Traxler | 340/539 |

*Primary Examiner*—Glen Swann
*Attorney, Agent, or Firm*—Gary M. Hartman; Domenica N. S. Hartman

[57] ABSTRACT

A child monitoring system that includes a first unit (10) that is worn or is otherwise attached to a child, and a monitoring unit (12) intended to be possessed by a parent or guardian responsible for the child. The monitoring system serves to monitor the proximity of the child to the monitoring unit (12), and provides for alarms (22, 40, 42) at the child's and monitoring units (10, 12) that warn the guardian and those near the child that the child has moved beyond a preset distance from the monitoring unit (12).

9 Claims, 1 Drawing Sheet

CHILD PROXIMITY MONITOR AND ALARM

BACKGROUND OF THE INVENTION

1. Field of the Invention

The present invention generally relates to monitoring devices and systems. More particularly, this invention relates to a child monitoring system that provides an alarm when a child has moved beyond a preset distance from a monitoring unit.

2. Description of the Prior Art

Various electronic devices have been suggested for monitoring the presence or location of persons or objects, including bracelets worn by individuals under house arrest to determine whether the individual is present in the designated house, and car chips placed in cars and used to locate the cars if stolen. An example of the former is disclosed in U.S. Pat. No. 4,736,196 to McMahon et al., and entails a band to be worn on the individual's wrist or ankle. The band houses a trigger, transmitter and antenna, with the trigger being activated by a signal from a portable control unit to operate the transmitter. When activated, the transmitter emits a signal that is detected by the control unit to verify the proximity of the band.

Significant emphasis has recently been placed on electronic systems intended to promote the safety of children, including devices worn by children to prevent their abduction. One such system is disclosed in U.S. Pat. No. 4,694,284 to Leveille et al. as consisting of a band worn by the individual being monitored. The band includes a transmitter that, upon activation of the transmitter by the wearer, broadcasts a VHF-UHF signal that can be received by a number of conventional receivers, including televisions. A drawback to this system is that a child would be required to activate the emergency signal, which may not be possible due to his or her age or under the circumstances of his or her abduction. A similar system is disclosed in U.S. Pat. No. 5,438,315 to Nix, and includes a bracelet having a transmitting unit that emits a radio signal when activated with a switch by the wearer, and a remote unit that emits an audible alarm when the radio signal is received from the bracelet. Again, required activation by the wearer can be difficult or impossible for a child.

A locating system specifically intended for children is disclosed in U.S. Pat. No. 5,617,074 to White. This system includes a receiver unit tended by an adult and a transmitting unit that is worn by a child. The transmitting unit can be turned on once the unit is appropriately fastened to the child, and then continuously emits a signal that is received and monitored by the receiving unit. Accordingly, this system is suitable for children of all ages because the wearer is not required to activate the transmitting unit in order for the system to operate as intended. The receiving unit is depicted in a drawing, but not described in any detail, as including a message receiving unit, alarms, and a distance programmer. The function of the distance programmer is not clear due to the lack of a written description of the receiving unit.

While the locating system taught by White is well suited for continuously monitoring the location of a child, improvements and additional safety features would be desirable. For example, the system disclosed by White does not include any feature that might discourage a would-be abductor from taking the child wearing the transmitting unit.

SUMMARY OF THE INVENTION

According to the present invention, there is provided a child monitoring system that includes a first unit that is worn or is otherwise attached to a child, and a monitoring unit intended to be possessed by a guardian responsible for the child. The monitoring system of this invention monitors the proximity of the child to the monitoring unit and provides for alarms at the child's and monitoring units that warn the guardian and those near the child that the child has moved beyond a preset distance from the monitoring unit.

The monitoring unit of this invention includes means for transmitting a monitoring signal to the child's unit, means for selectively altering the distance over which the monitoring signal is transmitted, means for receiving a response signal from the child's unit, an alarm that is activated when the monitoring unit no longer receives the response signal from the child's unit, and means for emitting a deactivation signal. The child's unit, which may be concealed within jewelry or another suitable article adapted to be worn by a child, includes means for receiving the monitoring signal from the monitoring unit, means for transmitting the response signal to the monitoring unit, an alarm that sounds when the child's unit does not receive the monitoring signal from the monitoring unit due to exceeding the distance set by the monitoring unit, means for receiving the deactivation signal from the monitoring unit, and means for deactivating the child unit alarm when the child's unit receives the deactivation signal from the monitoring unit.

With the present invention, a child can play anywhere within the circle whose radius is established by the distance designated with the monitoring unit. However, the alarm on the child's unit will sound when the monitoring signal from the monitoring unit is interrupted, i.e., when the child's unit has moved outside the region monitored by the monitoring unit. In addition, the monitoring unit alarm will also sound in response to the response signal from the child's unit, which may be selected to transmit the response signal only when the monitoring signal is detected by the child's unit, or alternatively to transmit the response signal only when the monitoring signal is not detected by the child's unit. The alarm on the child's unit can only be deactivated with the deactivation signal transmitted by the monitoring unit. Preferably, the deactivation signal is only effective after the child's unit has first been unlocked with a special key, which prevents the child's unit from being accidently turned "off" or turned "off" by unauthorized persons.

From the above, it can be appreciated that the monitoring system of this invention provides an immediate warning to the child's guardian and those near the child that the child is not where he or she should be. This aspect of the invention is a critical additional safety feature that interferes with an abductor's ability to remove a child outside the area being monitored by the monitoring unit. Specifically, once the guardian sets the permitted distance that the child can roam from the monitoring unit, removal of the child beyond the set distance by an abductor will set off the child unit's alarm, bringing immediate attention to the abductor. This alarm can only be deactivated with the monitoring unit or destruction of the child's unit. The latter possibility can be readily hindered by manufacturing the child's unit to have a watertight enclosure formed of a strong material that resists cutting.

Other objects and advantages of this invention will be better appreciated from the following detailed description.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 1:
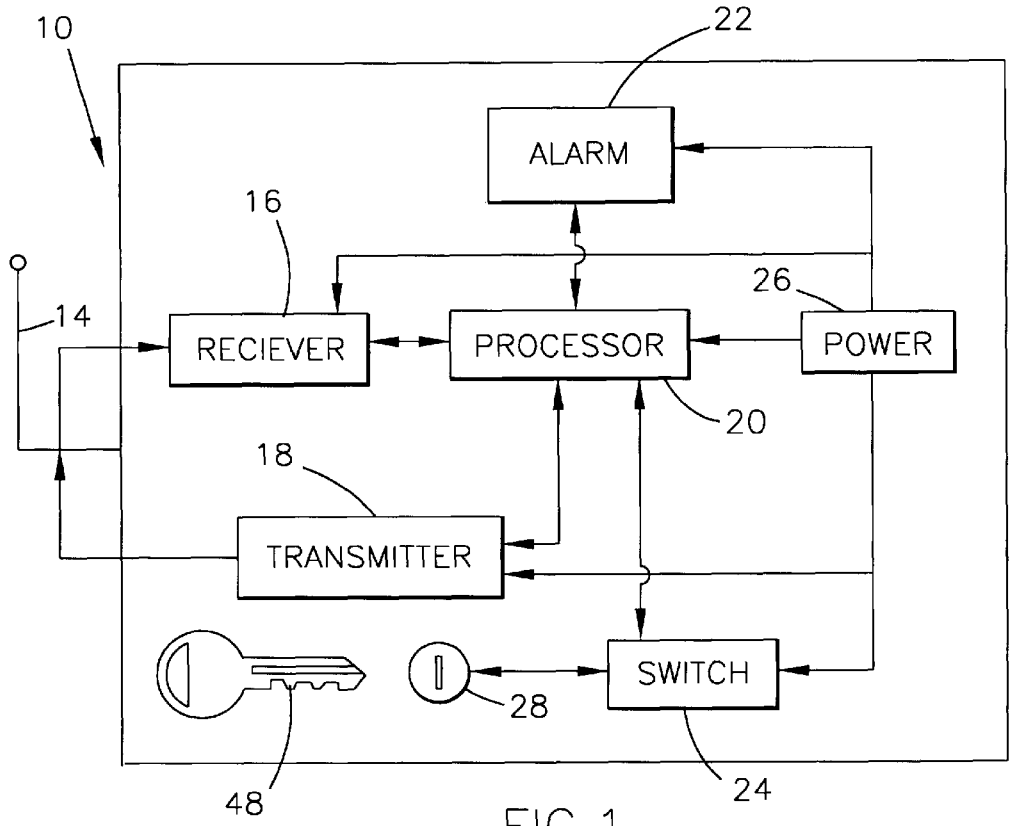
FIG. 1 shows a block diagram of a child safety bracelet in accordance with a preferred embodiment of the present invention.
Figure 2:
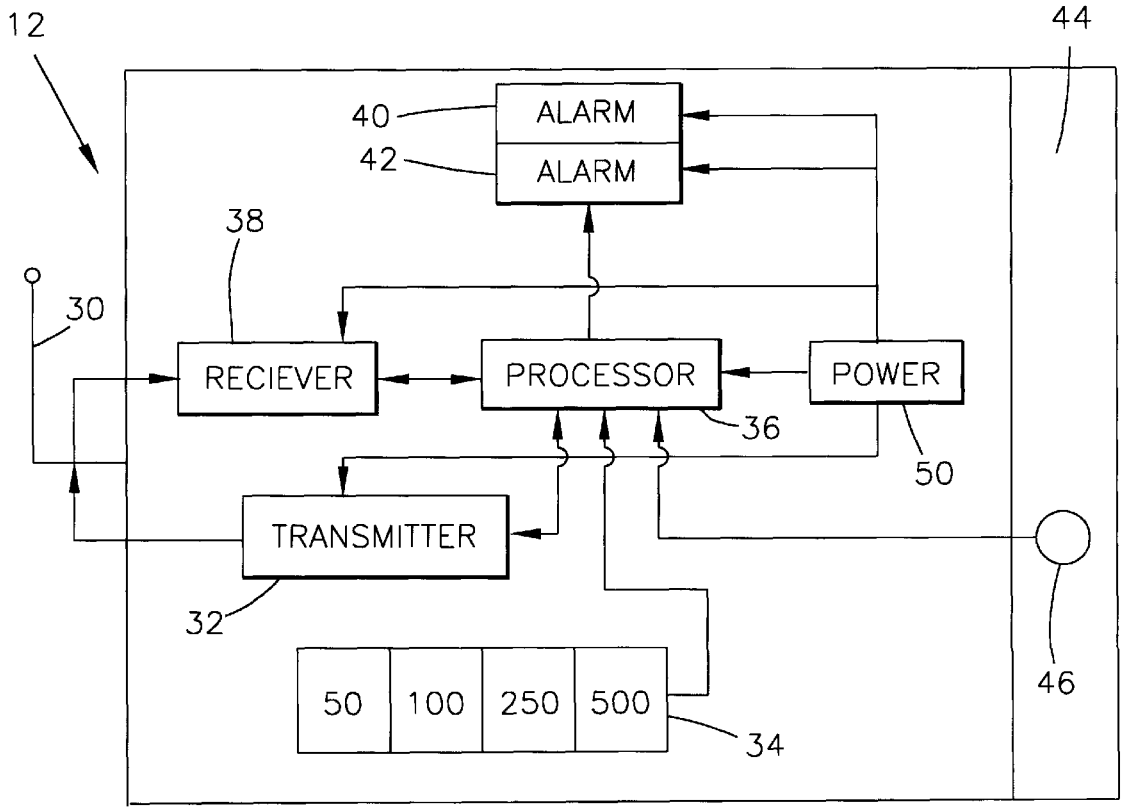
FIG. 2 shows a block diagram of a monitoring unit in accordance with the preferred embodiment of the invention.

A child monitoring system in accordance with this invention is represented by the block diagrams shown in FIGS. 1 and 2. FIG. 1 represents a child'unit 10 that is worn or is otherwise attached to a child. For example, the unit could be a bracelet that may be worn on the wrist or ankle of a child as jewelry, with the indicated electronic components enclosed in the bracelet for protection from the elements and unauthorized attempts to disarm or remove the bracelet. Suitable materials and construction methods for this purpose are within the capability of those skilled in the art, and will not be discussed in any great detail. It is generally sufficient to say that the child's unit 10 is preferably enclosed within a watertight enclosure that resists cutting and protects the unit 10 from other potential damage that might be inflicted by one trying to remove or deactivate the unit 10. The enclosure can be readily disguised with a decorative plastic or metallic coating, which is also within the ordinary skill in the art.

FIG. 2 represents a monitoring unit 12 that is intended to be held by the child's parent or a designated guardian who is responsible for the child. Accordingly, the monitoring unit 12 is preferably contained within an enclosure that is convenient for a person to carry. Examples include configuring the unit 12 to look similar to a car alarm remote that can be attached to clothing or a key ring. When the child's unit 10 is worn by a child, the child's unit 10 and the monitoring unit 12 cooperate to monitor the proximity of the child to the monitoring unit 12, and both units 10 and 12 are equipped with alarms that sound if the child's unit 10, and therefore the child, has moved beyond a preset distance from the monitoring unit 12.

With further reference to FIG. 1, the child's unit 10 includes an internal antenna 14 and a receiver 16 for detecting a monitoring signal generated by the monitoring unit 12. The antenna 14 and receiver 16 are both designed to detect the monitoring signal emitted from the maximum distance that can be set by the monitoring unit 12, as will be explained later. For example, the monitoring unit 12 may be programmed to emit a monitoring signal that is broadcast a distance of 50, 100, 250 or 500 feet, necessitating that the antenna 14 and receiver 16 be capable of detecting a signal from 500 feet away. The child's unit 10 further includes a transmitter 18 for transmitting a response signal to the monitoring unit 12, which is for the purpose of notifying the monitoring system 12 that the child's unit 10, and therefore the wearer, has exceeded the distance set by the monitoring unit 12 and therefore no longer detects the monitoring signal from the monitoring unit 12. If the receiver 16 cannot detect the monitoring signal, a processor 20 relays a signal to an alarm 22 that emits an audible distress signal, preferably an extremely loud sound on the order of about 120 dB. Simultaneously, the processor 20 relays a signal to the transmitter 18 to either begin or cease broadcasting of the response signal—if the unit 10 is designed to continuously broadcast the response signal, the processor 20 instructs the transmitter 18 to terminate the signal; otherwise, the transmitter 18 begins broadcasting the response signal in response to instructions from the processor 20.

Once the alarm 22 is activated by the processor 20, the alarm 22 can only be turned "off" with a special key (designated as 48 in FIG. 1), securable to the monitoring unit 12, that is inserted into a keyhole 28 on the unit 10, followed by an appropriate signal from the monitoring unit 12. In the preferred embodiment in which the unit 10 is in the form of a bracelet, the key 48 is also necessary to remove the bracelet and its enclosed unit 10 from the child. The "deactivation" signal necessary to turn "off" the alarm 22 is detected by the receiver 14 and relayed to the processor 20, which subsequently sends an appropriate signal to a switching unit 24. The switching unit 24 preferably turns the alarm 22 "off" by interrupting power to the alarm 22 from a power source 26, such as a battery. Alternatively, the switching unit 24 can merely turn the alarm 22 "off" and place the unit 10 in a "standby" mode with reduced power requirements.

With reference to FIG. 2, the monitoring unit 12 includes an internal antenna 30 and a transmitter 32 for broadcasting the monitoring signal to the child's unit 10. A keypad 34 or other suitable device is provided to enable the user to select the distance over which the monitoring signal is transmitted by the transmitter 32. The keypad 34 communicates with a processor 36, which controls the transmitter 32. The unit 12 also includes a receiver 38 connected to the antenna 30 for receiving the response signal from the child's unit 10. A visual alarm 40 and an audible alarm 42 are activated when the monitoring unit 12 no longer receives the response signal from the child's unit 10 or, alternatively, if the unit 12 detects the response signal, depending on the designed operating mode of the unit 10. The visual alarm 40 may be a flashing red light, while the audible alarm 42 preferably consists of a continuous beep. A suitable power source 50 provides power to the transmitter 32, processor 36, receiver 38 and alarms 40 and 42.

The monitoring unit 12 further includes a foldout portion 44 with a button 46 that must be pressed to send the deactivation signal to the child's unit 10. The foldout portion 44 also houses the key 48 required to remove the unit 10 from the child, turn the child's unit 10 "on," and turn the alarm 22 "off." If the child's unit 10 is capable of a low-power "standby" mode, the monitoring unit 12 may be designed to broadcast an "activation" signal via the transmitter 32 that causes the child's unit 10 to assume an "armed" status, in which the alarm 22 will sound if the monitoring signal is not received by the child's unit 10 from the monitoring unit 12.

To use the monitoring system of this invention, the child's guardian places the child's unit 10 (e.g., in the form of a bracelet) on the child's wrist or ankle, and turns the child's unit 10 "on" with the key 48. At this time, the guardian also pushes the appropriate key 34 to set the distance that the guardian will permit the child to roam from the monitoring unit 12. If the child moves beyond the permitted distance, the alarm 22 on the child's unit 10 will sound to notify those near the child, as will the alarms 40 and 42 on the monitoring unit 12 in response to the response signal from the child's unit 10. The alarm 22 on the child's unit 10 can be deactivated with the guardian's key 48 followed by the deactivation signal transmitted by the monitoring unit 10.

While the invention has been described in terms of a preferred embodiment, it is apparent that other forms could be adopted by one skilled in the art. Accordingly, the scope of the invention is to be limited only by the following claims.

What is claimed is:

1. A child proximity sensor and alarm system comprising:

a monitoring unit comprising:

means for transmitting a monitoring signal;

means for selectively altering a distance over which the monitoring signal is transmitted by the transmitting means;

means for receiving a response signal;

an alarm that is activated when the response signal receiving means does not receive the response signal; and means for emitting a deactivation signal; and an article adapted to be worn by a child, the article comprising:

means for receiving the monitoring signal from the monitoring unit;

means for transmitting the response signal to the monitoring unit, transmission of the response signal by the response signal transmitting means being dependent on whether the monitoring signal is detected by the monitoring signal receiving means;

an alarm that sounds when the monitoring signal receiving means does not receive the monitoring signal;

means for receiving the deactivation signal from the monitoring unit; and means for deactivating the alarm of the article when the deactivation signal receiving means receives the deactivation signal from the monitoring unit.

2. A system as recited in claim 1, wherein the alarm of the monitoring unit is an audible alarm that is activated when the response signal receiving means does not receive the response signal from the article.

3. A system as recited in claim 1, wherein the alarm of the monitoring unit is a visual alarm that is activated when the response signal receiving means does not receive the response signal from the article.

4. A system as recited in claim 1, the monitoring unit further comprising means for transmitting an activation signal, the article further comprising means for receiving the activation signal from the activation signal transmitting means of the monitoring unit, the activation signal causing the article to assume an "armed" status by which the alarm of the article will sound if the monitoring signal receiving means does not receive the monitoring signal from the monitoring unit.

5. A system as recited in claim 1, wherein the response signal transmitting means transmits the response signal only when the monitoring signal is detected by the monitoring signal receiving means.

6. A system as recited in claim 1, wherein the response signal transmitting means transmits the response signal only when the monitoring signal is not detected by the monitoring signal receiving means.

7. A system as recited in claim 1, the monitoring unit further comprising a key and the article further comprising means for receiving the key to remove the article from the child.

8. A system as recited in claim 1, wherein the key and the deactivation signal are both required to turn the alarm of the article "off."

9. A child proximity sensor and alarm system comprising:

a monitoring unit comprising:

means for transmitting a monitoring signal;

means for selectively altering a distance over which the monitoring signal is transmitted by the transmitting means;

means for receiving a response signal;

an audible alarm and a visual alarm that are activated when the response signal receiving means does not receive the response signal;

a key; and means for emitting a deactivation signal; and a bracelet adapted to be worn by a child, the bracelet comprising:

means for receiving the monitoring signal from the monitoring unit;

means for transmitting the response signal to the monitoring unit, the response signal transmitting means transmitting the response signal only when the monitoring signal is detected by the monitoring signal receiving means;

an alarm that sounds when the monitoring signal receiving means does not receive the monitoring signal;

means for receiving the deactivation signal from the monitoring unit;

means for receiving the key to remove the article from the child; and means for deactivating the alarm of the article after the key has been inserted into the key receiving means and when the deactivation signal receiving means receives the deactivation signal from the monitoring unit.

* * * * *